United States Patent [19]

Richards

[11] Patent Number: 4,531,525

[45] Date of Patent: Jul. 30, 1985

[54] METHODS OF KNITTING BRASSIERE BLANK, MANUFACTURING BRASSIERE, AND PRODUCTS

[76] Inventor: Mark S. Richards, Apartment 1, 351 Elm St., Laconia, N.H. 03246

[21] Appl. No.: 554,935

[22] Filed: Nov. 25, 1983

[51] Int. Cl.[3] ..... A41C 3/00; D04B 7/04

[52] U.S. Cl. ..... 128/489; 66/176; 66/189; 128/463; 128/494; 128/517

[58] Field of Search ..... 66/176, 189; 128/494, 128/463, 465, 489, 517; D2/24

[56] References Cited

U.S. PATENT DOCUMENTS 3,500,665 3/1970 Braxton et al. ..... 128/494

3,537,279 11/1970 Epley ..... 128/489

3,772,899 11/1973 Novi ..... 66/176

*Primary Examiner*—Doris L. Troutman

*Attorney, Agent, or Firm*—Daniel E. McConnell

[57] ABSTRACT

This invention relates to methods of manufacturing blanks for brassieres, brassieres, and the products of such methods. In particular, the methods and products involve circular knitting operations in which the blank is produced as a cylindrical tube, and thereafter cut and sewn to produce a garment having straps knit integrally with a frontal torso portion having breast cups and a dorsal torso portion cooperating with the frontal torso portion in forming a torso band.

10 Claims, 4 Drawing Figures

METHODS OF KNITTING BRASSIERE BLANK, MANUFACTURING BRASSIERE, AND PRODUCTS

FIELD AND BACKGROUND OF INVENTION

This invention relates to methods of manufacturing blanks for brassieres, brassieres, and the products of such methods. In particular, the methods and products involve circular knitting operations in which the blank is produced as a cylindrical tube, and thereafter cut and sewn to produce a garment having straps knit integrally with a frontal torso portion having breast cups and a dorsal torso portion cooperating with the frontal torso portion in forming a torso band.

It has been proposed heretofore that brassieres may be produced by knitting processes, including full fashioned processes as shown in Braxton et al U.S. Pat. No. 3,500,665 and reciprocatory processes using circular knitting machines as shown in Epley U.S. Pat. No. 3,537,279. With such processes, shaped fabric areas are formed to define breast cups. With other processes, such as that of Novi U.S. Pat. No. 3,772,899, shaping is accomplished by aftertreatment of the manufactured fabric, rather than by knitting of shaped fabric areas.

With both full fashioned and reciprocatory knitting processes, blank and garment production is significantly slower and less efficient than is possible for other garments, such as tubular stockings or pantyhose, where technology has permitted fabric formation by circular knitting. That is, where the cylinder of a circular knitting machine may be driven in continuous rotation as distinct from reciprocation, the rate of fabric production and thus the manufacturing efficiency is significantly enhanced.

BRIEF DESCRIPTION OF INVENTION

With the above discussion in mind, it is an object of this invention to manufacture a brassiere blank in the form of a circular knit, cylindrical tube. In realizing this object of the present invention, a method of manufacturing such a garment blank in accordance with this invention realizes high speed, efficient production while providing a blank which can be readily and efficiently manufactured into the finished garment. Inasmuch as the blank is a circular knit, cylindrical tube, the blank is rapidly produced by a circular knitting machine of the general class used heretofore in the manufacture of pantyhose and the like, and a plurality of blanks may be produced in rapid succession.

Yet a further object of this invention is to provide a blank for the manufacture of a brassiere garment which has a fabric construction shaped to contours desired for the finished garment so as to minimize the manufacturing steps required for completion of the garment. In realizing this object of the invention, a circular knit fabric blank is produced which has distinctive stitch structures in courses so as to form a pair of turned welts at opposite ends of a cylindrical tube; a frontal torso portion knit to one welt and having a pair of breast cups defined by two areas in which the courses are plain knit with the areas being separated by areas of gathered panels in which succeeding courses vary between plain and welt knit courses, the courses defining the frontal torso portion differentially shaping the breast cups with respect to the gathered panels; and a fabric strap and dorsal torso portion knit to the frontal torso portion and the other welt. The blank having such a stitch structure may thereafter be slit longitudinally, opened flat, and fabricated into the finished garment with a minimal number of operations.

Yet a further object of this invention is to provide a brassiere garment fabricated from circularly knit fabric and in which differential stitch structures in coursewise directions accomplish the principal shaping of the finished garment. In such a garment, a torso encircling band portion formed by a frontal turned welt and a dorsal turned welt which are sewn together at lateral seam lines is knit to a frontal torso portion having a pair of breast cups defined by two areas in which the courses are plain knit with the areas being separated by a center gathered panel area in which succeeding courses vary between plain and welt knit courses, the courses defining the frontal torso portion differentially shaping the breast cups with respect to the gathered panel, and is knit to a fabric strap and dorsal torso portion.

BRIEF DESCRIPTION OF DRAWINGS

Some of the objects of the invention having been stated, other objects will appear as the description proceeds, when taken in connection with the accompanying drawings, in which.

DETAILED DESCRIPTION OF INVENTION

Figure 1:
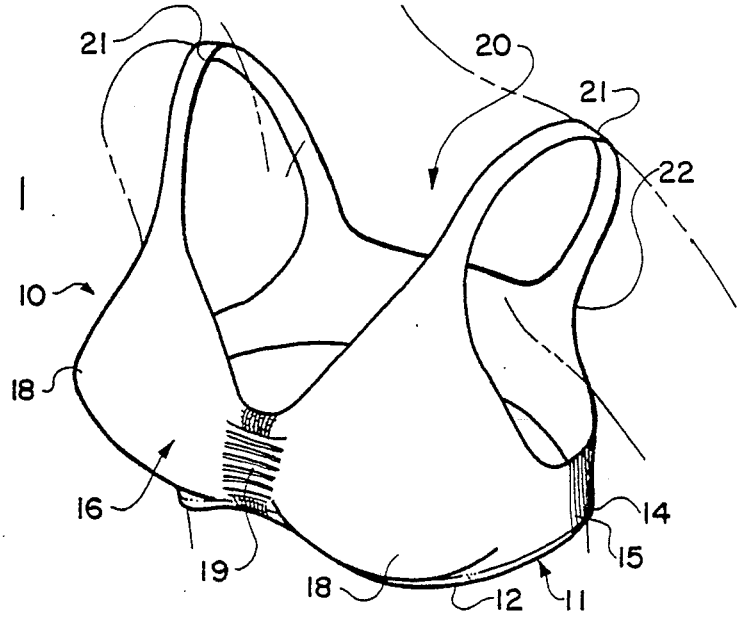
FIG. 1 is a perspective view of a brassiere garment embodying the present invention.

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Referring now more particularly to the drawings, the finished garment of the present invention, as worn by a consumer, is represented generally at 10 and, as shown there, comprises a torso encircling band portion 11 formed by a frontal turned welt 12 and a dorsal turned welt 14 which are sewn together at lateral seam lines (one of which is seen at 15). The band portion 11 is knit to a frontal torso portion 16 which has a pair of breast cups 18 defined by two areas in which the courses are plain knit with the areas being separated by a center gathered panel area 19 in which succeeding courses vary between plain and welt knit courses, the courses defining the frontal torso portion differentially shaping the breast cups with respect to the gathered panel. The frontal torso portion 16 is knit to a fabric strap and dorsal torso portion 20 which includes straps 21 and a dorsal torso portion 22.

In accordance with this invention, the brassiere is of a circular knit construction, with the welts 12, 14 extending in a coursewise direction. Thus, the fabric construction in the frontal torso portion 16 is such that the coursewise direction of the knit fabric is generally circumferential of the body of the wearer of the garment 10. This is a distinction from prior garments of this general class. The courses are knit in such a way as to shape the breast cups 18. In particular, the fabric in the breast cup portions is a "simple" knit, while panels adjacent the breast cup portions are formed by fabric which is gathered by reason of having successive courses varying between "simple" knit and welt knit stitches.

As used herein, reference to "simple" knit is intended to distinguish those stitch constructions possible on a circular knitting machine and in which yarn is taken into a needle during each rotation of the cylinder, such as plain, purl, tuck and combinations thereof. Reference to welt knit is intended to encompass miss-stitch or float-stitch constructions in which loops in certain courses are held without additional yarns being taken and then knit into subsequent courses, thereby gathering the courses together and providing the characteristic turned welt or panel effects referred to above. It is believed that this brief description will enable persons of skill in the knitting arts to comprehend the variations which may be made while attaining the desired result of this invention in the differential shaping of the various portions of the blank and garment here described.

In the brassiere 10 of FIG. 1, the center gathered panel 19 may be constructed with alternate needles producing plain stitches and float stitches, or may be constructed with every fourth needle producing plain stitches and the intervening needles producing float stitches. In either instance, yarn held as in a float stitch is held for a multiplicity of courses, in the range of from three courses to twenty two courses. As will be understood, the degree of shaping will vary, and may be taken into account in accomplishing sizing of the garment. Additionally, the brassiere 10 has side gathered panels (as will become more clear from the discussion which follows with regard to the blank and method of manufacture) which are similarly constructed. Thus the breast cups 18 are defined between the center panel and two side panels. The side panels are located at the lateral seam lines 15 and are joined thereby to dorsal side panels as described more fully hereinafter.

Figure 2:
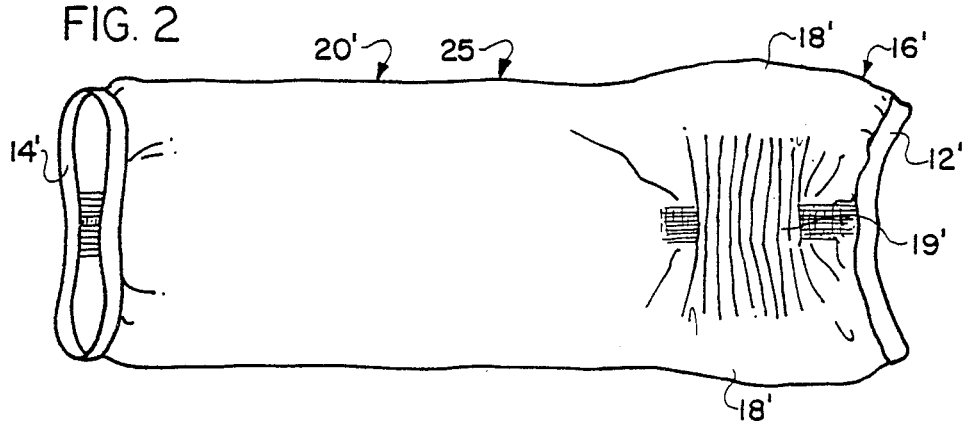
FIG. 2 is a front elevation view of a circular knit, cylindrical blank in accordance with the present invention and from which the garment of FIG. 1 is manufactured.

The brassiere 10 is produced from a blank 25 (FIGS. 2 and 3) which is produced on a high speed circular knitting machine as generally mentioned above. The blank 25 is a cylindrical tube, having portions which (upon manufacture of the garment 10) correspond to the portions of the garment described above. For that reason, reference characters corresponding to those used above with reference to FIG. 1 will be applied in FIGS. 2 and 3, with the addition of prime notation. Thus the frontal welt 12' is, in the blank 25, a circular turned welt as is produced on circular knitting machines in well known ways. Similarly, the dorsal welt 14' is a circular turned welt, and the differentially shaped breast cups 18' are defined between the gathered center panel 19' and the (now visible) gathered side panels 26 which extend longitudinally of the tube diametrically opposite the location of the center panel 19'. The side panels 26 define therebetween a cut line 28, for purposes to be made more clear hereinafter.

As will be appreciated, the portions of the tubular blank 25 are integrally knit together and have stitch constructions as described hereinabove. Thus the method of manufacturing the blank will become more clearly understandable and may be characterized as knitting a series of courses defining a first cylindrical tubular fabric portion in the form of a turned welt, and then knitting to the first turned welt portion a series of courses defining a cylindrical tubular fabric frontal torso portion having a pair of breast cups defined by two areas in which the courses are plain knit with the areas being separated one from another by areas of gathered panels in which succeeding courses vary between plain knit and welt knit courses, the knitting of courses defining the frontal torso portion differentially shaping the breast cups with respect to the gathered panels, and then knitting to the frontal torso portion a series of courses defining a cylindrical tubular fabric strap and dorsal torso portion having an elongated area in which the courses are simple knit with the area being divided by an elongated panel area in which succeeding courses vary between simple knit and welt knit courses, and then knitting to the strap and dorsal torso portion a series of courses defining a second cylindrical tubular fabric portion in the form of a turned welt.

Figure 3:
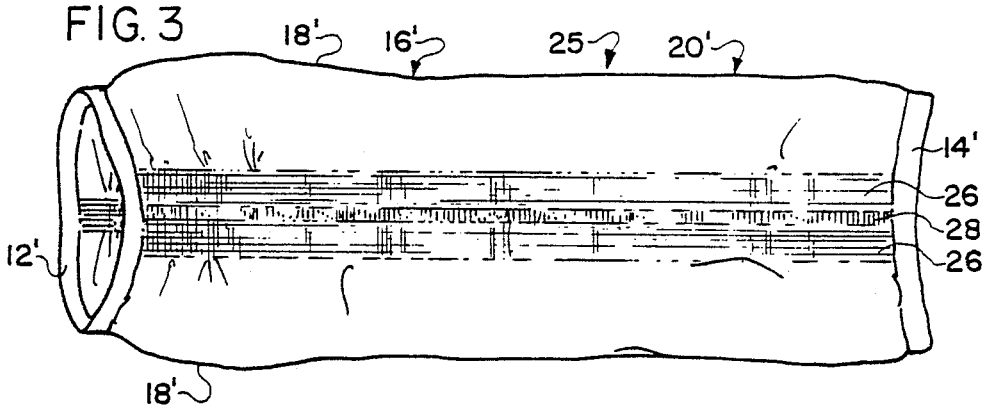
FIG. 3 is a rear elevation view of the blank of FIG. 2.

As will be apparent from FIG. 3, the elongated panel area which extends through the dorsal portion is, in the blank 25, formed by the side panels 26 and the cut line 28 and extends from and through what will ultimately be both the frontal and dorsal portions of the finished garment 10.

Figure 4:
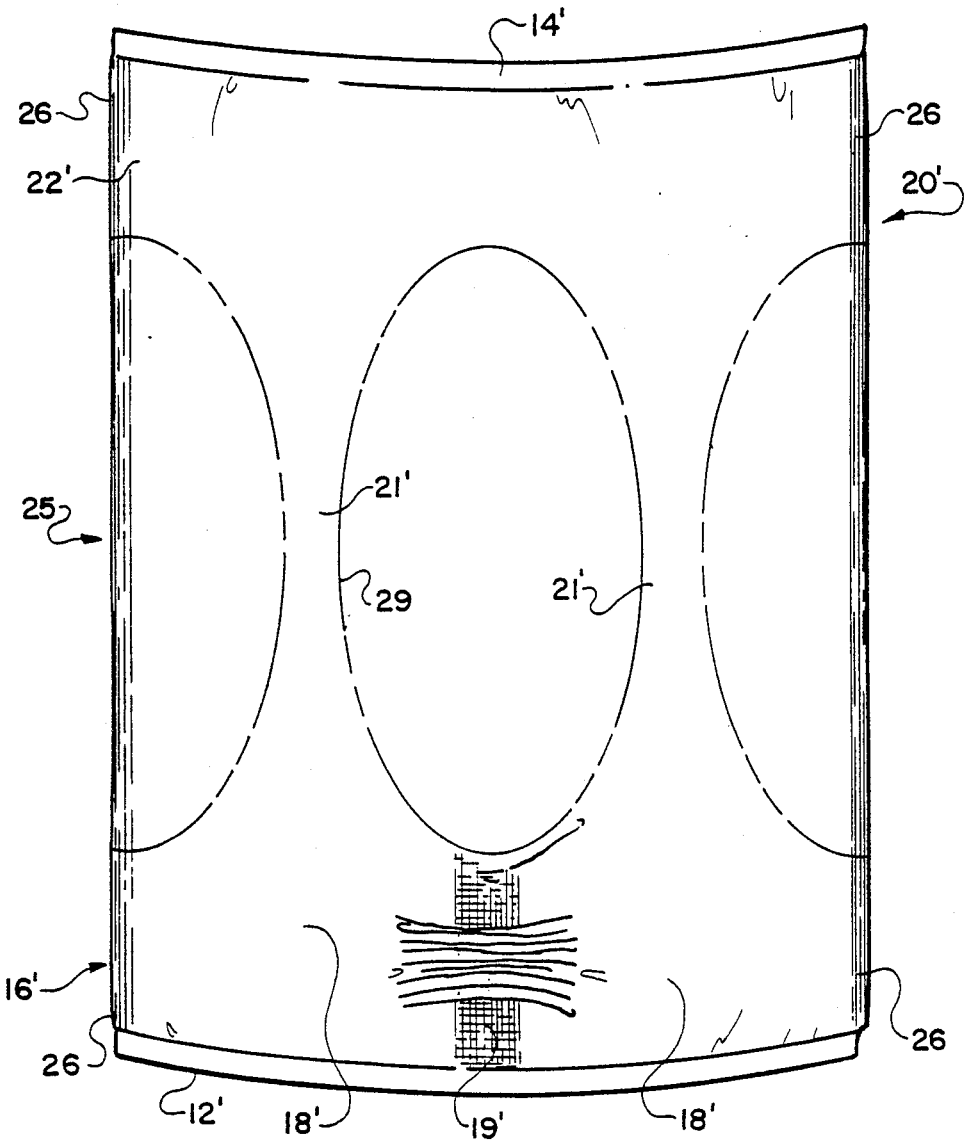
FIG. 4 is a front elevation view of the blank of FIGS. 2 and 3 as slit, opened and undergoing manufacture of the garment of FIG. 1.

In manufacturing the garment 10 from the blank 25, the fabric of the blank is slit along the cut line 28 and the blank is opened flat to the form shown in FIG. 4. The flat blank is then cut along a neck line 29 and a pair of armhole lines 30 and fabric is removed so as to define the straps 21' and dorsal portion 22'. The slit and cut blank is then folded and the side panels 26 and welts 12', 14' sewn together. Trims and the like may be applied if desired for appearance reasons.

In the drawings and specifications there has been set forth a preferred embodiment of the invention and, although specific terms are used, the description thus given uses terminology in a generic and descriptive sense only and not for purposes of limitation.

What is claimed is:

1. A method of making a circular knit blank for the manufacture of a brassiere comprising the steps of:

knitting a series of courses defining a first cylindrical tubular fabric portion in the form of a turned welt, and then knitting to the first turned welt portion a series of courses defining a cylindrical tubular fabric frontal torso portion having a pair of breast cups defined by two areas in which the courses are simple knit with the areas being separated one from another by areas of gathered panels in which succeeding courses vary between simple knit and welt knit courses, the knitting of courses defining the frontal torso portion differentially shaping the breast cups with respect to the gathered panels, and then knitting to the frontal torso portion a series of courses defining a cylindrical tubular fabric strap and dorsal torso portion having an elongated area in which the courses are simple knit with the area being divided by an elongated panel area in which succeeding courses vary between simple knit and welt knit courses, and then knitting to the strap and dorsal torso portion a series of courses defining a second cylindrical tubular fabric portion in the form of a turned welt.

2. A method according to claim 1 wherein the step of knitting to the first turned welt portion a series of courses defining a cylindrical tubular fabric frontal torso portion having areas of gathered panels in which succeeding courses vary between simple knit and welt knit courses comprises knitting a gathered center panel in which a multiplicity of successive courses are of float stitches.

3. A method according to claim 1 wherein the step of knitting to the first turned welt portion a series of courses defining a cylindrical tubular fabric frontal torso portion having areas of gathered panels in which succeeding courses vary between simple knit and welt knit courses comprises knitting a gathered side panel in which a multiplicity of successive courses are of float stitches.

4. A circular knit blank for the manufacture of a brassiere comprising:

a first cylindrical tubular fabric portion in the form of a turned welt, a cylindrical tubular fabric frontal torso portion knit to the first welt portion and having a pair of breast cups defined by two areas in which the courses are simple knit with the areas being separated one from another by areas of gathered panels in which succeeding courses vary between simple knit and welt knit courses, the courses defining the frontal torso portion differentially shaping the breast cups with respect to the gathered panels, a cylindrical tubular fabric strap and dorsal torso portion knit to the frontal torso portion and having an elongated area in which the courses are simple knit with the area being divided by an elongated panel area in which succeeding courses vary between simple knit and welt knit courses, and a series of courses defining a second cylindrical tubular fabric portion in the form of a turned welt knit to the strap and dorsal torso portion.

5. A blank according to claim 4 wherein the frontal torso portion having areas of gathered panels in which succeeding courses vary between simple knit and welt knit courses has a gathered center panel in which a multiplicity of successive courses are of float stitches.

6. A blank according to claim 4 wherein the frontal torso portion having areas of gathered panels in which succeeding courses vary between simple knit and welt knit courses has a gathered side panel in which a multiplicity of successive courses are of float stitches.

7. A method of making a brassiere using a circular knit blank and comprising the steps of:

knitting a series of courses defining a first cylindrical tubular fabric portion in the form of a turned welt, then knitting to the first turned welt portion a series of courses defining a cylindrical tubular fabric frontal torso portion having a pair of breast cups defined by two areas in which the courses are simple knit with the areas being separated one from another by areas of gathered panels in which succeeding courses vary between plain knit and welt knit courses, the knitting of courses defining the frontal torso portion differentially shaping the breast cups with respect to the gathered panels, then knitting to the frontal torso portion a series of courses defining a cylindrical tubular fabric strap and dorsal torso portion having an elongated area in which the courses are simple knit with the area being divided by an elongated panel area in which succeeding courses vary between plain knit and welt knit courses, then knitting to the strap and dorsal torso portion a series of courses defining a second cylindrical tubular fabric portion in the form of a turned welt, then slitting the cylindrically knit tube longitudinally along the elongated panel area, then opening the slit tube into a flat fabric blank, then cutting and removing from the flat fabric blank areas of the strap and dorsal torso portion so as to form thereof a pair of straps each extending from adjacent a breast cup portion to a dorsal band portion, then sewing together the slit gathered panels at side edges of the frontal and dorsal torso portions so as to form of the welt portions a torso encircling band.

8. A brassiere made of circularly knit fabric and comprising:

a torso encircling band portion in the form of a frontal turned welt and a dorsal turned welt, the welts being sewn together at lateral seam lines, a frontal torso portion knit to the frontal welt and having a pair of breast cups defined by two areas in which the fabric is in plain knit courses with the areas being separated one from another by areas of gathered panels in which the fabric is in succeeding courses which vary between plain knit and welt knit courses, the courses defining the frontal torso portion differentially shaping the breast cups with respect to the gathered panels, a dorsal torso portion knit to the dorsal welt and in which the fabric is in simple knit courses, and a pair of strap portions each knit to both of the frontal and dorsal torso portions and in which the fabric is in simple knit courses.

9. A brassiere according to claim 8 wherein the frontal torso portion having areas of gathered panels in which succeeding courses vary between plain knit and welt knit courses has a gathered center panel in which a multiplicity of successive courses are of float stitches.

10. A brassiere according to claim 8 wherein the frontal torso portion having areas of gathered panels in which succeeding courses vary between plain knit and welt knit courses has gathered side panels adjacent the seam lines and in which a multiplicity of successive courses are of float stitches.

* * * * *